US007205724B2

(12) United States Patent
Ahn et al.

(10) Patent No.: US 7,205,724 B2
(45) Date of Patent: Apr. 17, 2007

(54) BACKLIGHT DRIVING SYSTEM FOR A LIQUID CRYSTAL DISPLAY DEVICE

(75) Inventors: In Ho Ahn, Taegu-kwangyokshi (KR); Pu Jin Kim, Kumi-shi (KR); Dong Yun Lee, Seongnam-shi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 187 days.

(21) Appl. No.: 10/953,874

(22) Filed: Sep. 28, 2004

(65) Prior Publication Data

US 2005/0225514 A1 Oct. 13, 2005

(30) Foreign Application Priority Data

Mar. 15, 2004 (KR) ..... 10-2004-0017365

(51) Int. Cl.
*H05B 37/02* (2006.01)

(52) U.S. Cl. ..... 315/209 R; 315/291

(58) Field of Classification Search ..... 315/224, 315/307, 312, 244, 245, 209, 291, 169.3, 315/225, 209 R, 308; 345/100, 102; 363/95
See application file for complete search history.

(56) References Cited

U.S. PATENT DOCUMENTS 7,016,208 B2 * 3/2006 Price et al. ..... 363/132
7,030,568 B2 * 4/2006 Boke et al. ..... 315/224
2003/0142060 A1 * 7/2003 Lee et al. ..... 345/102
2003/0214478 A1 * 11/2003 Yoo et al. ..... 345/102
2004/0056830 A1 * 3/2004 Lee et al. ..... 345/87
2004/0104884 A1 * 6/2004 Takeda et al. ..... 345/102
2004/0113631 A1 * 6/2004 Hyeon-Yong ..... 324/510
2004/0207339 A1 * 10/2004 Lin et al. ..... 315/291
2004/0232853 A1 * 11/2004 Hur et al. ..... 315/291
2005/0057181 A1 * 3/2005 Izumi et al. ..... 315/209 R
2005/0062436 A1 * 3/2005 Jin ..... 315/244
2005/0146907 A1 * 7/2005 Jeon et al. ..... 363/98
2006/0043910 A1 * 3/2006 Chan et al. ..... 315/291
2006/0087262 A1 * 4/2006 Kim et al. ..... 315/312

FOREIGN PATENT DOCUMENTS

| | | |
|---|---|---|
| CN | 1458547 | 11/2003 |
| JP | 2000-138097 | 5/2000 |
| JP | 2001-244094 | 9/2001 |
| KR | 1020030089299 | 11/2003 |

* cited by examiner

*Primary Examiner*—Tuyet Vo
*Assistant Examiner*—Tung Le
(74) *Attorney, Agent, or Firm*—Brinks Hofer Gilson & Lione

(57) ABSTRACT

A backlight driving system is provided for a liquid crystal display device. The backlight driving system comprises at least one backlight having at least one terminal, an inverter and at least one transformer. The inverter supplies a voltage to the backlight and has first and second output terminals. The transformer has a first input coil and a second input coil that are connected to the first and the second output terminals of the inverter. The transformer transforms the voltage outputted from the inverter and applies a transformed voltage to the backlight via the terminal of the backlight.

28 Claims, 3 Drawing Sheets

BACKLIGHT DRIVING SYSTEM FOR A LIQUID CRYSTAL DISPLAY DEVICE

PRIORITY CLAIM

This application claims the benefit of Korean Application No. P2004-17365, filed on Mar. 15, 2004. The disclosure of the above application is incorporated herein by reference.

BACKGROUND

1. Technical Field

The invention relates to a liquid crystal display device, and more particularly, to a backlight driving system for a liquid crystal display device.

2. Related Art

Generally, display devices are compact and lightweight. Although Cathode Ray Tubes ("CRT") have been widely used for television monitors, a measuring system and an information terminal, they do not provide a compact and light display device due to their inherent size and weight. Accordingly, CRTs have been replaced by other display devices such as a liquid crystal display ("LCD") device, a plasma display panel ("PDP") and an electroluminescence display ("ELD") device. Among those display devices, LCD devices use an electric field optical effect and can provide advantages such as low power consumption and a slim, lightweight structure. As a result, applications of LCD devices range from monitors for personal computers, including desktop and laptop computers, to large size display devices.

Some LCD devices control light transmittance from ambient light to display images. Others use an additional light source, such as a backlight unit, in an LCD panel. FIG. 1 illustrates a circuit diagram of a backlight driving system 1 for a LCD device. Referring to FIG. 1, a backlight is a lamp 10 that emits light to a liquid crystal display panel (not shown). The lamp 10 may be a cold cathode fluorescent lamp (CCFL). The backlight driving system includes a first inverter 11, a second inverter 12, a first transformer 13 and a second transformer 14. The first inverter 11 outputs a driving voltage to a first terminal 2 of the lamp 10 in accordance with a control signal of a timing controller 15. Likewise, a second inverter 12 outputs a driving voltage to a second terminal 4 of the lamp 10 in accordance with a control signal of the timing controller 15. Then, the first transformer 13 transforms an output voltage of the first inverter 11 and supplies a transformed output to the first terminal 2 of the lamp 10. In the same manner, the second transformer 14 transforms an output voltage of the second inverter 12 and supplies a transformed output to the second terminal 4 of the lamp 10. Each input coil 5, 5' of the first and the second transformers 13 and 14 is connected to output terminals 6, 8, 6', 8' of the first and second inverters 11 and 12, respectively. Each output coil 7, 7' of the first and the second transformers 13 and 14 are connected to the first terminal 2 and the second terminal 4 of the lamp 10.

The first inverter 11 includes a first transistor, a second transistor, a third transistor, and a fourth transistor M1, M2, M3, and M4. The third transistor M3 and the first transistor M1 are connected in series between a voltage terminal (VCC) and a ground terminal (GND). The fourth transistor M4 and the second transistor M2 are connected in series between the voltage terminal (VCC) and the ground terminal (GND). The first output terminal 6 is formed between the third transistor M3 and the first transistor M1, and the second output terminal 8 is formed between the fourth transistor M4 and the second transistor M2. Thus, the first and second output terminals 6, 8 are each connected to the input coil 5 of the first transformer 13.

The second inverter 12 has the same structure as the first inverter 11 as described above. Specifically, the first output terminal 6' is formed between the third transistor M3 and the first transistor M1, and the second output terminal 8' is formed between the fourth transistor M4 and the second transistor M2. Thus, the first and second output terminals 6', 8' are each connected to the input coil 5' of the second transformer 14.

A dot (●) marked on the input coils 5, 5' of the transformers 13, 14 indicates a starting point of the input coil 5, 5'. Volts Alternating Current ("VAC") is a sine wave that is outputted from the first and the second transformers 13, 14. A VAC outputted from the second transformer 14 has an inverted phase from a VAC outputted from the first transformer 13.

The backlight driving system 1 described above has the following disadvantages. The system 1 requires the first inverter 11, the second inverter 12, the first transformer 13 and a second transformer 14 to supply a desired voltage to the first and the second terminals 2, 4 of the lamp 10. Accordingly, the system 1 is large in size and the power consumption increases. Also, fabrication cost substantially increases. In addition, due to a difference in impedance generated between each load of the first inverter 11⇆first transformer 13⇆lamp 10 and the second inverter 12⇆second transformer 14⇆lamp 10, non-uniform voltage may be transmitted to each end terminal 2, 4 of the lamp 10. This non-uniform voltage reduces product reliability.

Use of only one inverter and one transformer may not provide the desired uniformity or equally divide and output the voltage. This, a single inverter/transformer backlight driving system provides non-uniform and unequal voltages that may be transmitted to each end terminal of a lamp. This non-uniform and unequal voltage results in non-uniform brightness of the lamp.

SUMMARY

A backlight driving system is provided for a liquid crystal display device that includes a plurality of lamps, an inverter and first and second transformers. The lamps have a first terminal and a second terminal. The inverter outputs a voltage to be supplied to the plurality of lamps and has first and second output terminals. The first and the second transformers have first and second input coils connected to the first and the second output terminals of the inverter, respectively. The first and the second transformers transform a voltage outputted from the inverter and apply a transformed voltage to at least the first terminal of each lamp. A controller outputs control signals for controlling the inverter.

In one embodiment, each first input coil of the first transformer and the second transformer may be formed by a first wire, and each second input coil of the first transformer and the second transformer may be formed by a second wire.

A backlight driving system may further include a first common electrode line commonly connecting the first terminals of each lamp, a second common electrode line commonly connecting the second terminals of each lamp, and a plurality of capacitors connected between the first and the second common electrode lines and each lamp. In one embodiment, an output of the first transformer may be connected to the first common electrode line, and an output of the second transformer may be connected to the second common electrode line. Alternatively or additionally, both outputs of the first transformer and the second transformer may be connected to the first common electrode, and the second common electrode line may be grounded.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE EMBODIMENTS

Figure 1:
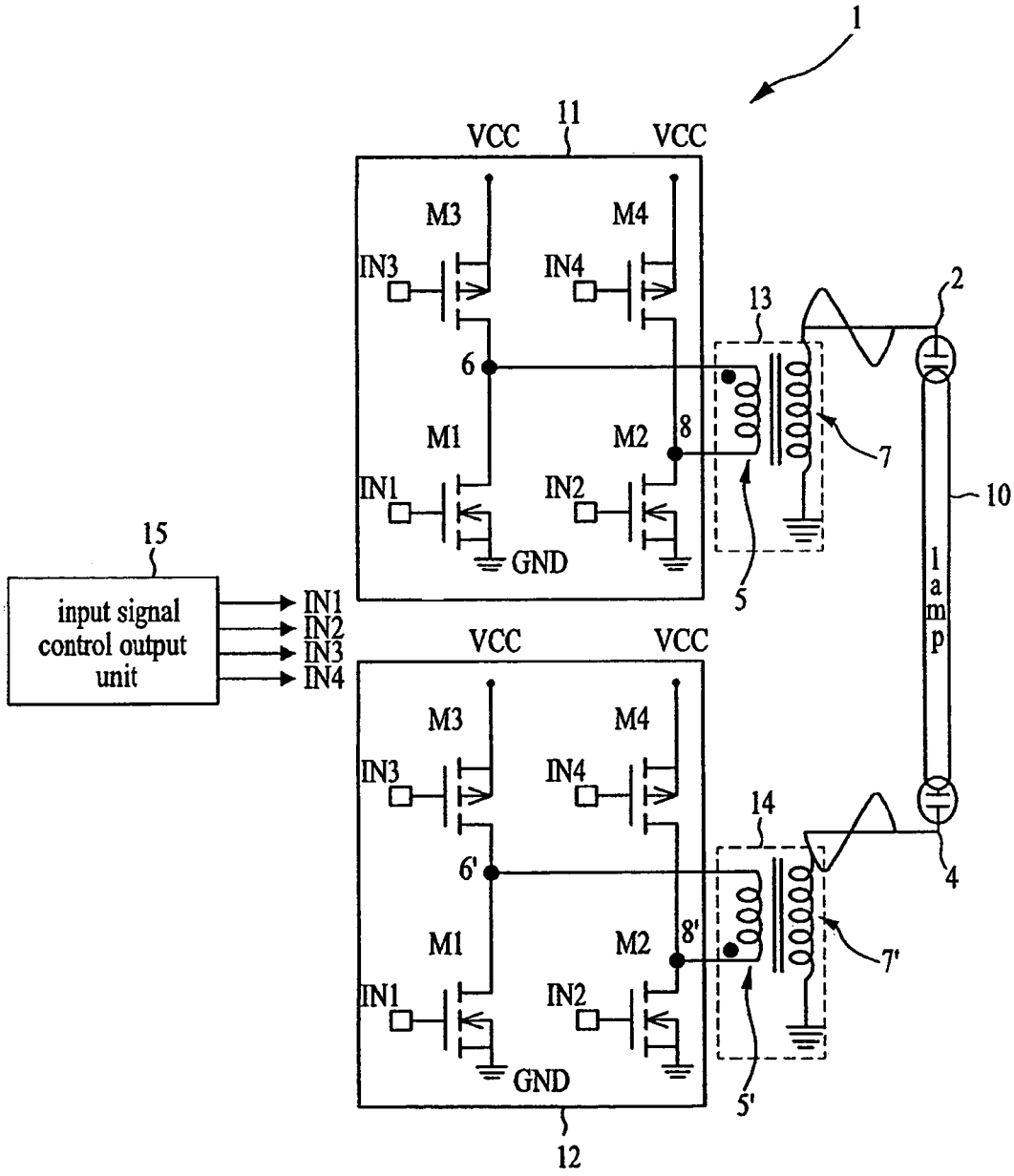
FIG. 1 Related Art
FIG. 1 illustrates a circuit diagram of a related art backlight driving system for a liquid crystal display device.
Figure 2:
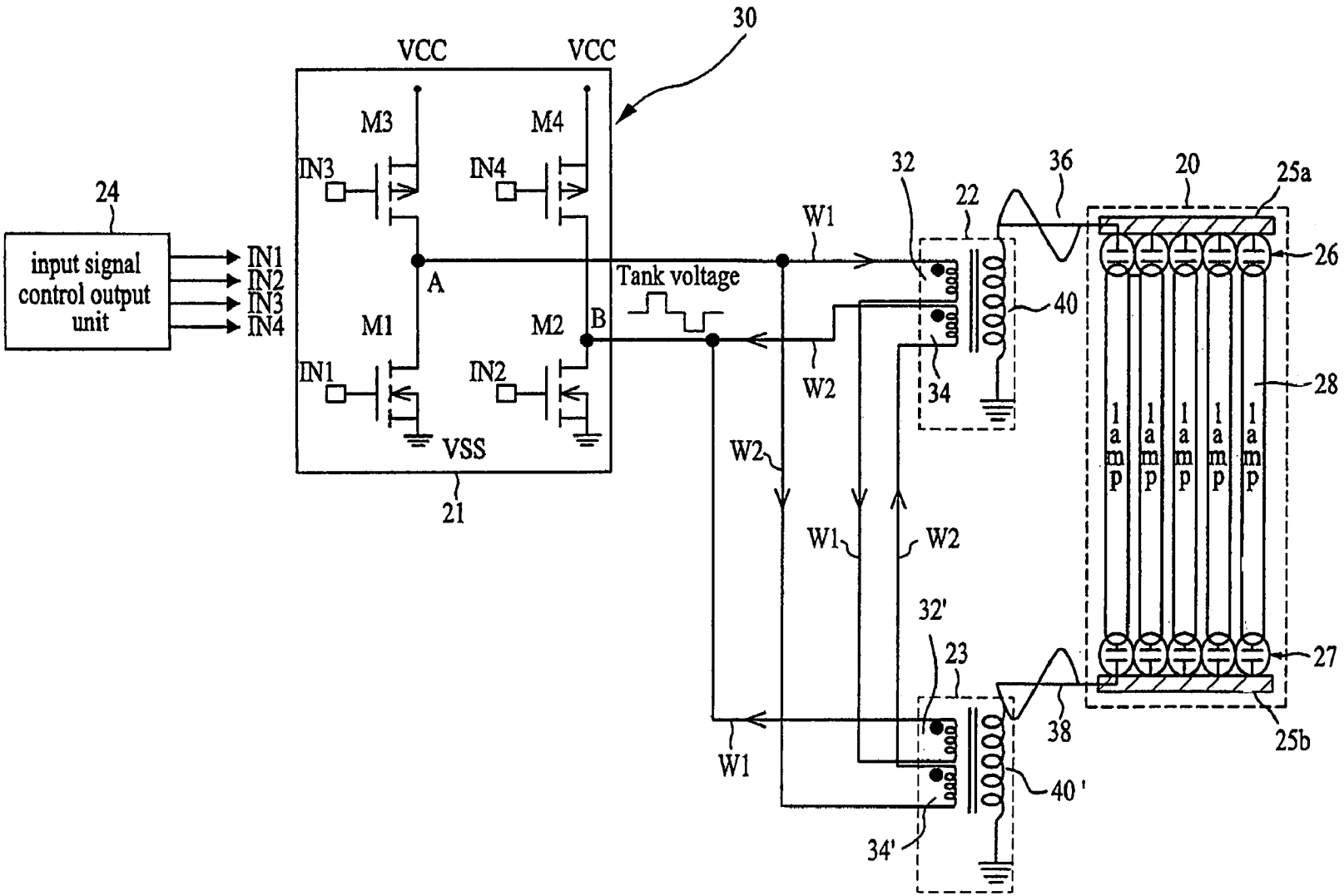
FIG. 2 illustrates a circuit diagram of a first embodiment of a backlight driving system.

FIG. 2 illustrates a circuit diagram of a backlight driving system 30 according to a first embodiment. In the first embodiment, the backlight driving system 30 drives a backlight by supplying a high voltage at each end terminal of a lamp unit 20. The lamp unit 20 includes a plurality of lamps 28 aligned in one direction. An inverter 21 outputs a voltage for turning on the plurality of lamps 28 in accordance with a control signal. First and second transformers 22 and 23 have first and second input coils 32, 32' and first and second output coils 34, 34'. The first and second input coils 32, 32' are wound between the first and second output terminals A and B to cross one another. By using this structure, the transformers 22, 23 transform the voltage outputted from the inverter 21 and supply a transformed voltage to first and second end terminals 36, 38 of the lamp unit 20. A control unit 24 outputs control signals for controlling the inverter 21.

The lamp unit 20 includes a first common electrode line 25*a* commonly connecting a first end terminal 36 of the plurality of lamps 28 and a second common electrode line 25*b* commonly connecting a second end terminal 38 of the plurality of lamps 28. A plurality of first capacitors 26 are connected between the first common electrode line 25*a* and the first end terminal 36 of lamps 28, and a plurality of second capacitors 27 are connected between the second common electrode line 25*b* and the second end terminal 38 of the plurality of lamps 28. The lamp 28 used here may be a cold cathode fluorescent lamp (CCFL). Alternatively or additionally, an external electrode fluorescent lamp (EEFL) having an electrode on each external end of a tube may be used for the lamp 28.

The inverter 21 includes first, second, third, and fourth transistors M1, M2, M3, and M4. The third transistor M3 and the first transistor Ml are connected in series between a voltage terminal (VCC) and a ground terminal (VSS). Likewise, the fourth transistor M4 and the second transistor M2 are connected in series between the voltage terminal (VCC) and the ground terminal (VSS). A first output terminal "A" outputs a first output signal and is connected between the third transistor M3 and the first transistor M1. A second output terminal "B" outputs a second output signal and is connected between the fourth transistor M4 and the second transistor M2. Tank voltage, which is a generally oscillating voltage, is outputted from the first and the second output terminals A and B as shown in FIG. 2. The transistors M1~M4 may be MOS transistors. For example, the first and second transistors M1, M2 are formed of NMOS transistors, and the third and fourth transistors M3, M4 are formed of PMOS transistors.

The control unit 24 outputs first, second, third and fourth output signals IN1, IN2, IN3, and IN4 in order to control the first, second, third, and fourth transistors M1~M4 of the inverter 21, respectively. Volts Alternating Current (VAC) is a sine wave that is outputted from an output coil 40 of the first transformer 22. As shown in FIG. 2, a VAC having an inverted phase is outputted from an output coil 40' of the second transformer 23. The output coil 40 of the first transformer 22 is connected to the first common electrode line 25*a*, and the output coil 40' of the second transformer 23 is connected to the second common electrode line 25*b*.

The first and second input coils 32, 34, 32', 34' of the first and second transformers 22 and 23 are wound between the first output terminal A and the second output terminal B to cross a first wire W1 and a second wire W2. Specifically, the first wire W1 extends from the first output terminal A to the second output terminal B of the inverter 21. The first wire W1 is connected to the first output terminal A, the first input coil 32 of the first transformer 22, the first input coil 32' of the second transformer 23, and the second output terminal B of the inverter 21 (i.e., the first input coil 32 of the first transformer 22→the first input coil 32' of the second transformer 23→the second output terminal B of the inverter 21). At this point, the first wire W1 is wound so that the direction of the first input coil 32 of the first transformer 22 and the direction of the first input coil 32' of the second transformer 23 become opposite to one another. A dot (●) marked on each first input coil 32, 32' of the first and second transformers 22 and 23 indicates a starting point of winding of the coil 32, 32'.

In addition to the first wire W1, the second wire W2 extends from the first output terminal A to the second output terminal B of the inverter 21. The second wire W2 is connected to the first output terminal A, the second input coil 34' of the second transformer 23, the second input coil 34 of the first transformer 22, and the second output terminal B of the inverter 21 (i.e., the second input coil 34' of the second transformer 23→the second input coil 34 of the first transformer 22→the second output terminal B of the inverter 21). A dot (●) marked on the second input coil 34, 34' of the first and second transformers 22 and 23 indicates a starting point of winding of the coil 34, 34'.

As described above, the first input coils 32, 32' share the first wire W1, and the second input coils 34, 34' share the second wire W2. As a result, each transformer shares a uniform and equal voltage. Even if a first current transmitted to the first input coils 32, 32' is not precisely half of the entire current outputted from the inverter 21, a second current transmitted to the first and second transformers 22 and 23 through the second input coils 34, 34' can compensate the first current. Accordingly, divided currents are uniform and equal, and the first and second transformers 22 and 23 can output uniform signals.

Figure 3:
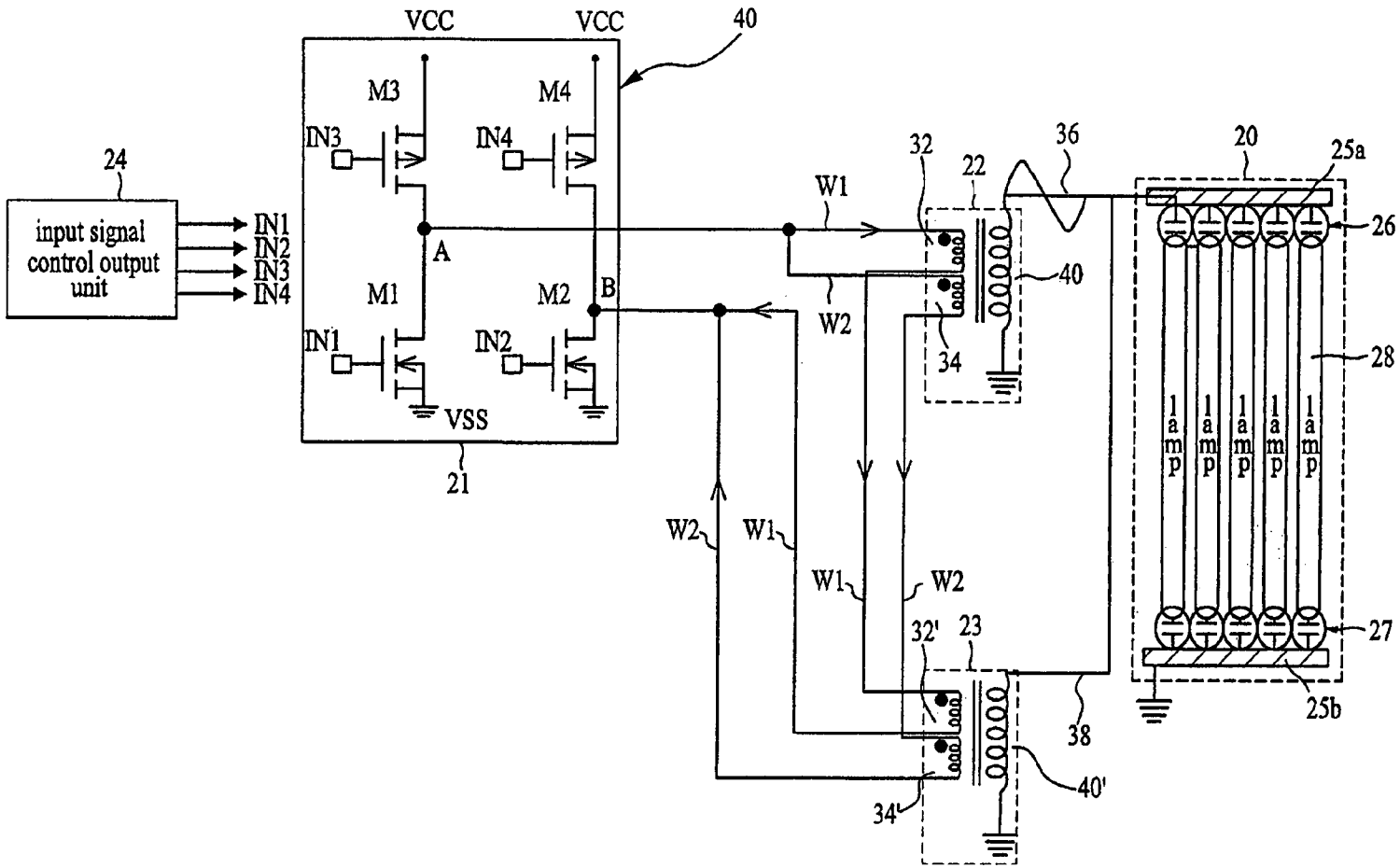
FIG. 3 illustrates a circuit diagram of a second embodiment of a backlight driving system.

FIG. 3 illustrates a circuit diagram of a backlight driving system 40 according to a second embodiment. In the second embodiment, the backlight driving system 40 drives a backlight by applying a high voltage to one end terminal of a lamp and a low voltage to the other end terminal of the lamp. As shown in FIG. 3, applying a voltage to each end terminal of the lamp through first and second transformers and winding first and second wires W1 and W2 to form input coils of the transformers are different from the first embodiment.

Referring to FIG. 3, a lamp unit 20 has a plurality of lamps 28 aligned in one direction. An inverter 21 outputs a voltage for turning on the plurality of lamps 28 in accordance with a control signal. First and second transformers 22, 23 have first and second input coils 32, 32', 34, 34' and first and second output coils 40, 40'. The first and the second input coils 32, 32', 34, 34' are connected to the first and second output terminals A and B. The transformers 22, 23 transform the voltage outputted from the inverter 21 and supply a transformed voltage to first and second end terminals 36, 38 of the lamp unit 20. A control unit 24 outputs control signals for controlling the inverter 21.

The lamp unit 20 includes a first common electrode line 25*a* commonly connecting the first end terminal 36 of the plurality of lamps 28 and a second common electrode line 25*b* commonly connecting the second end terminal 38 of the plurality of lamps 28. A plurality of first capacitors 26 are connected between the first common electrode line 25*a* and the first end terminal 36 of each lamp 28, and a plurality of second capacitors 27 are connected between the second common electrode line 25*b* and the second end terminal 38 of each lamp 28. The first common electrode 25*a* is connected to output coils 40, 40' of the first and second transformers 22 and 23 to receive a sine wave VAC. Unlike the first embodiment, the second common electrode line 25*b* is grounded and the plurality of second capacitors 27 may be omitted. Lamps 28 may be formed by using a cold cathode fluorescent lamp (CCFL). Alternatively or additionally, the lamps 28 may be an external electrode fluorescent lamp (EEFL) having an electrode on each external end of a tube.

The inverter 21 includes first, second, third, and fourth transistors M1, M2, M3, and M4. The third transistor M3 and the first transistor M1 are connected in series between a voltage terminal (VCC) and a ground terminal (VSS). The fourth transistor M4 and the second transistor M2 are connected in series between the voltage terminal (VCC) and the ground terminal (VSS). A first output terminal "A" outputting a first output signal is connected between the third transistor M3 and the first transistor M1. A second output terminal "B" outputting a second output signal is connected between the fourth transistor M4 and the second transistor M2. The transistors M1~M4 may be MOS transistors. For example, the first and second transistors are NMOS transistors, and the third and fourth transistors are PMOS transistors.

The first and second input coils 32, 32', 34, 34' of the first and second transformers 22 and 23 are each connected to the first output terminal A and the second output terminal B of the inverter 21. The first wire W1 extends from the first output terminal A to the second terminal B of the inverter 21. The first wire W1 is wound to form the first input coil 32 of the first transformer 22 and the first input coil 32' of the second transformer 23. Then, the first wire W1 is connected to the second output terminal B of the inverter 21. The first wire W1 is connected in the following order: the first input coil 32 of the first transformer 22→the first input coil 32' of the second transformer 23→the second output terminal B of the inverter 21. On the other hand, the second wire W2 extends from the first output terminal A to the second output terminal B of the inverter 21. The second wire W2 is wound to form the second input coil 34 of the first transformer 22 and the second input coil 34' of the second transformer 23. Then, the second wire W2 is connected to the second output terminal B of the inverter 21. Specifically, the second wire W2 is connected in the following order: the first output terminal A of the inverter 21→the second input coil 34 of the first transformer 22→the second input coil 34' of the second transformer 23→the second output terminal B of the inverter 21. The first input coils 32, 32' of the first and second transformers 22, 23 are coiled in the same direction. In addition, the second input coils 34, 34' of the first and second transformers 22, 23 are coiled in the same direction.

As described above, the first input coils 32, 32' of the first and second transformers 22 and 23 share the first wire W1, and the second input coils 34, 34' of the first and second transformers 22 and 23 share the second wire W2. As a result, the transformers 22, 23 share a uniform and equal current. Therefore, even if a first current transmitted to the first input coils 32, 32' is not equal to the exact half of the entire current outputted from the inverter 21, a second current transmitted to each transformer through the second input coils 34, 34' can compensate the first current. Consequently, the first and second transformers 22 and 23 can output uniform signals.

The invention provides a backlight driving system having the following advantages. First and second input coils of first and second transformers share first and second wires. Accordingly, equal and uniform amount of current is controlled to be transmitted to each end terminal of a lamp. This results in uniform brightness of the lamp and enhancement in product reliability. In addition, a plurality of lamps can be turned on by using a single inverter, thereby simplifying an entire backlight unit system. Consequently, both power consumption and fabrication cost are substantially reduced.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A backlight driving system, comprising:

a backlight having a terminal;

an inverter that supplies a voltage to the backlight, the inverter having a first output terminal and a second output terminal; and a transformer unit that transforms the voltage outputted from the inverter and provides a transformed voltage to the backlight via the terminal of the backlight, wherein the transformer includes a first input coil, a second input coil, a first output coil coupled to the first input coil and a second output coil coupled to the second input coil, and the first and the second input coils are connected to the first and the second output terminals of the inverter, wherein the first and second output coils are connected to the terminal of the backlight, and wherein the first input coil includes a first pair of coils and the second input coil includes a second pair of coils.

2. The system according to claim 1, further comprising a controller that outputs a control signal to drive the inverter.

3. The system according to claim 1, wherein the transformer unit includes a first transformer and a second transformer.

4. The system according to claim 3, wherein the first transformer includes the first input coil and the second transformer includes the second input coil.

5. The system according to claim 4, wherein the first transformer includes the first output coil and the second transformer includes the second output coil.

6. The system according to claim 1, wherein one coil of the first pair and one coil of the second pair are formed by a first wire.

7. The system according to claim 6, wherein the other coil of the first pair and the other coil of the second pair are formed by a second wire.

8. The system according to claim 1, further comprising:

at least one common electrode line connecting the terminal of the backlight;

and a plurality of capacitors disposed between the common electrode line and the backlight.

9. The system according to claim 8, wherein an output of the transformer unit is connected to the common electrode line.

10. The system according to claim 1, wherein the terminal of the backlight includes a first terminal and a second terminal, and the first output coil is connected to the first terminal and the second output coil is connected to the second terminal.

11. The system according to claim 1, wherein the terminal of the backlight includes a first terminal and a second terminal, and the first output coil and the second output coil are connected to the first terminal and the second terminal is grounded.

12. A backlight driving system, comprising:

a plurality of lamps, the lamps having a first terminal and a second terminal;

an inverter that supplies a voltage to the plurality of lamps, the inverter having a first output terminal and a second output terminal;

first and second transformers each having a first input coil and a second input coil connected to the first and second output terminals of the inverter, the first and the second transformers configured to transform the voltage outputted from the inverter and apply a transformed voltage to the first terminal of the plurality of lamps; and a controller that outputs control signals to drive the inverter.

13. The backlight driving system according to claim 12, further comprising:

a first common electrode line commonly connecting the first terminals of the lamps;

a second common electrode line commonly connecting the second terminals of the lamps; and a plurality of capacitors respectively connected between the first and second common electrode lines and the lamps.

14. The system according to claim 13, wherein an output of the first transformer is connected to the first common electrode line and an output of the second transformer is connected to the second common electrode line.

15. The system according to claim 13, wherein an output of the first transformer and an output of the second transformer are connected to the first common electrode and the second common electrode line is grounded.

16. The system according to claim 12, wherein the lamps include one of a cold cathode fluorescent lamp (CCFL) and an external electrode fluorescent lamp (EEFL).

17. The system according to claim 12, wherein the inverter includes a first transistor and a second transistor serially connected between a voltage terminal and a ground terminal, and a third transistor and a fourth transistor serially connected between the voltage terminal and the ground terminal, wherein the first output terminal is formed between the first and the second transistors, and wherein the second output terminal is formed between the third and the fourth transistors.

18. A backlight driving system, comprising:

at least one backlight;

an inverter having a first output terminal and a second output terminal and supplying a voltage to the backlight;

a first transformer including a first pair of input coils having a first coil and a second coil and transforming a voltage outputted from the inverter;

a second transformer including a second pair of input coils having a third coil and a fourth coil and transforming a voltage outputted from the inverter;

a controller outputting control signals to drive the inverter; and the first coil and the third coil are formed by a first wire.

19. The system according to claim 18, wherein the first wire extends from the first output terminal to the second output terminal of the inverter and forms the first coil and the third coil.

20. The system according to claim 19, wherein the first wire is connected to the first output terminal, the first coil, the third coil and the second output terminal.

21. The system according to claim 20, wherein the second wire extends from the first output terminal to the second output terminal of the inverter and forms the second coil and the fourth coil.

22. The system according to claim 21, wherein the second wire is connected to the first output terminal, the fourth coil, the second coil and the second output terminal of the inverter.

23. The system according to claim 21, wherein the second wire is connected the second coil and then, the fourth coil.

24. The system according to claim 18, wherein the second coil and the fourth coil are formed by a second wire.

25. The system according to claim 24, wherein the first wire extends from the first output terminal to the second output terminal of the inverter and forms the first coil and the third coil, and wherein the second wire extends from the first output terminal of the inverter to the second output terminal of the inverter and forms the fourth coil and the second coil.

26. The system according to claim 24, wherein the first wire is connected to the first output terminal, the first coil, the third coil and the second output terminal, and wherein the second wire is connected to the first output terminal, the fourth coil, the second coil and the second output terminal of the inverter.

27. The system according to claim 18, wherein the first coil and the third coil are wound in a direction opposite to one another.

28. The system according to claim 18, wherein the first and second coils of the first transformer and the third and fourth coils of the second transformer are coiled in the same direction.

* * * * *